United States Patent [19]

Gantt

[11] 4,031,850

[45] June 28, 1977

[54] SCHEDULE AND RECORD INDICATOR

[75] Inventor: Everett E. Gantt, Gadsden, Ala.

[73] Assignee: Sports Guides, Inc., Gadsden, Ala.

[22] Filed: Jan. 27, 1976

[21] Appl. No.: 652,813

[52] U.S. Cl. ..... 116/135; 35/9 E

[51] Int. Cl.[2] ..... G09F 9/00

[58] Field of Search ..... 116/135, 130; 235/89 R; 35/9 E, 31 E, 31 A, 35 R; 40/62, 64 R, 65

[56] References Cited

UNITED STATES PATENTS

| | | | |
|---|---|---|---|
| 1,641,982 | 9/1927 | McDade | 35/9 E |
| 2,828,713 | 4/1958 | Smith | 116/135 |
| 2,966,747 | 1/1961 | Johnson | 35/9 E |
| 3,083,906 | 4/1963 | Giuntini | 235/89 R |
| 3,431,885 | 3/1969 | Miklas | 116/135 |

*Primary Examiner*—S. Clement Swisher
*Assistant Examiner*—Denis E. Corr
*Attorney, Agent, or Firm*—Clarence A. O'Brien; Harvey B. Jacobson

[57] ABSTRACT

A schedule and record indicator having a sleeve portion with window areas and a slide member within said sleeve having future schedules and past records printed thereon for viewing through said window areas as the slide is moved within the sleeve. Alignment apertures and an alignment indicator are also provided in order to simplify the proper alignment of the information desired at the moment with the window areas. Means for frictionally retaining the slide in proper adjustment is also provided.

8 Claims, 4 Drawing Figures

1974 ACC STANDING
W. L. T. PTS OPP
ALL GAMES
S 6 VILL. W. FOREST
S 13 TENN. N. STATE
S 20 N.CAR. CINCY.
S 27 KENT CLEM
O 4 SYRA. VIRG.
1975 SCHEDULE
1974 RECORD
PULLTAB
PULLTAB

SCHEDULE AND RECORD INDICATOR

BACKGROUND OF THE INVENTION

1. Field of the Invention

This invention relates generally to guide and record devices wherein stored information may be readily retrieved when desired.

2. Description of the Prior Art

It is common with prior known devices to print up future schedules and past records of various opponents such as football teams, basket ball teams, ice hockey teams, baseball teams, etc. Such schedules and records are quite often printed on the backs of business cards, advertising brochures, flat packed gift items, etc. Very often both sides of conventional hand-out materials are used for such information, and quite often such devices are folded once or twice to provide multiple spaces for storing the desired records and schedules.

However, known devices generally just list the information thereon without any means for drawing a user's attention to one particular team schedule and/or part record. Multiple listing type storing schedule and record indicators often are confusing to the very people they are designed to interest. This in effect defeats the very purpose for which they are provided.

SUMMARY OF THE INVENTION

An object of the present invention is to provide a schedule and record indicator which is easy to use and yet eliminates confusion and unclearness of conventional schedule and record listing devices.

Another object of the present invention is to provide an easy to use, relatively inexpensive to produce, slide guide for storing future schedules and past records of opponent teams in a readily retrievable manner.

A further object of the present invention is to provide a slide guide having a sleeve member with window openings therein, an adjustable slide member within said sleeve, desired schedules and records pre-printed on said sleeve and slide, and complementary alignment means on the sleeve and slide provided so that said alignment means when properly aligned will assure that the proper schedule and record information will appear in the windows.

A still further object of the present invention is a schedule and record indicator having alignment means of a positive, dimple and aperture engaging type, to assure that once the indicator device is properly aligned to allow a desired schedule and record information to be available such alignment will be maintained until changed by the user.

Another further object of the invention is in the provision of a slide guide having a sleeve and slide member therein provided with finger recesses in the sleeve to permit ready access to the slide for movement and alignment thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 2, 3, 4:
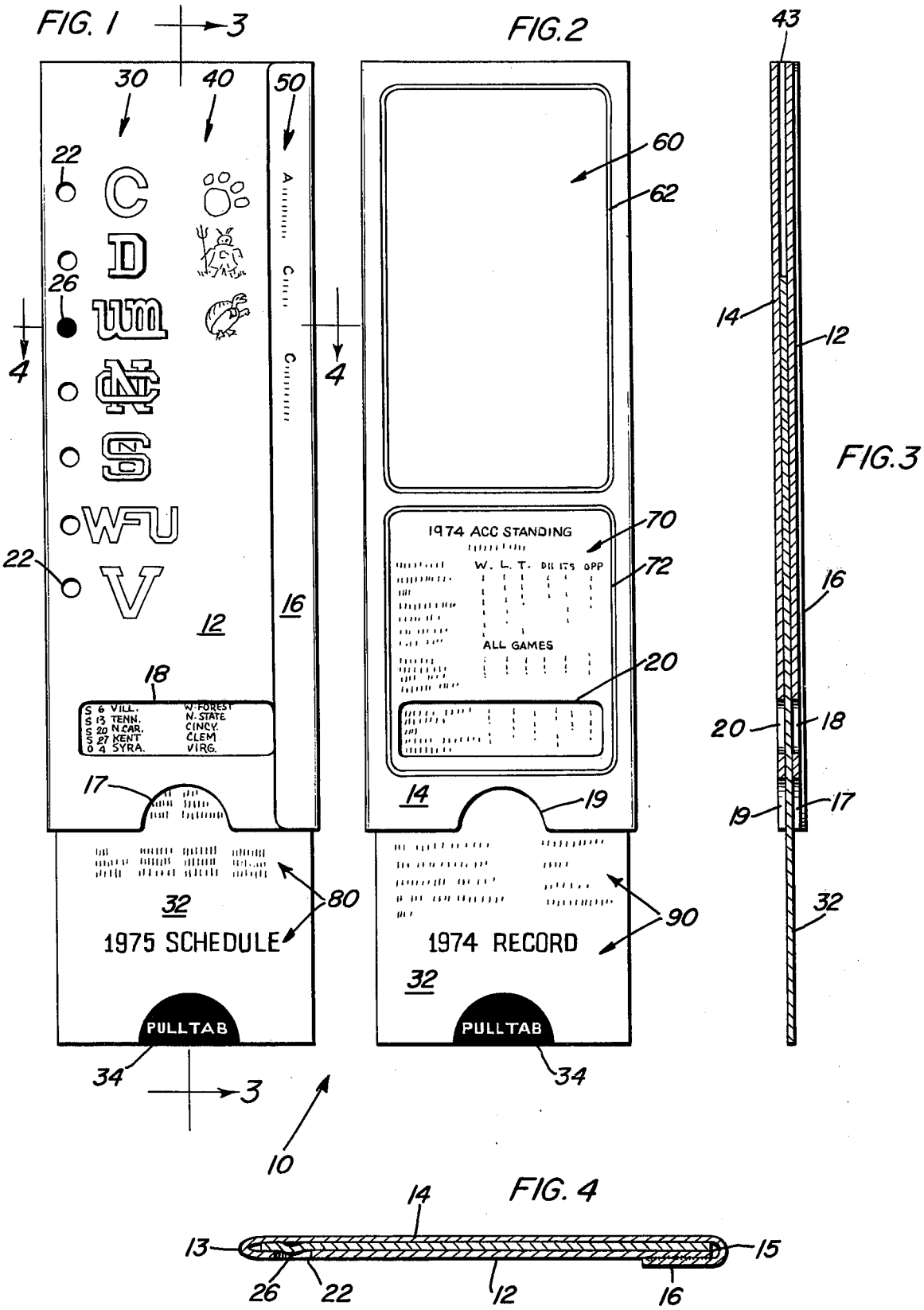
FIG. 1 is a front view of the schedule and record indicator of this invention.
FIG. 2 is a back view of said device.
FIG. 3 is a sectional view taken generally along line 3—3 of FIG. 1.
FIG. 4 is a sectional view taken generally along line 4—4 of FIG. 1.

Referring now more particularly to the drawings, the schedule and record indicator of this invention is shown from the front and back in FIGS. 1 and 2 respectively, and generally indicated by reference numeral 10. The device of this invention has a front panel member 12 and a back panel member 14 formed from a single sheet of material, such as cardboard, folded along an edge 13, best seen in FIG. 4, with the back portion 14 extending beyond the front portion 12 on the side opposite to edge 13. As seen in FIG. 4, the extending portion 16 is folded over the open edge of front member 12 to form a closed sleeve. This second fold is indicated by reference numeral 15 in FIG. 4. The overlapped interface between members 12 and 16 is appropriately fastened together by glue, epoxy, etc. While cardboard is preferable as material for the sleeve, plastic, fiberboard, and other like material may be used. Before the folding and assembly of the sleeve is done, and while the material being used is still in a flat condition appropriate information is printed, inscribed, silk screened, or otherwise applied to one side of the stock material, the side which will be on the outside of the sleeve after it is formed.

In addition to the application of information on the stock material before it is formed into a sleeve, window areas 18 and 20 are precut or prepunched as are the fingerhole recesses 17 and 19. Also alignment apertures 22, regularly spaced and along a line parallel with and slightly offset from the centerline of the rectangular piece of stock material, are also precut or prepunched. After the desired information is added and the proper openings are provided the sleeve is formed as described above.

As can best be seen in FIG. 3, once formed, the sleeve has an inner pocket 43. A slide member 32 which is just slightly of less width than the width of the sleeve and generally of the same length is precut from stock material similar to that from which the sleeve is made. Before inserting the slide member 32 into the sleeve pocket 43, appropriate schedule and record information is applied to said slide. This again may be by printing, inscribing, silk screening, etc. Also provision is made for proper alignment of the sleeve and slide by applying an indicator dot 26 along one edge of the slide member. In addition to the indicator dot having readily visible indicia thereon such as a black or color dot, the provision of a projecting dimple at this point is also envisioned. The function of the indicator dot and dimple will be described below.

In addition to the indicator dot 26 and the schedule and record information applied to the slide member 32, additional information, such as "Pull Tab" is preferably applied at 34 at the bottom of the slide member 32. This pull tab indicia will appropriately line up with the recessed portions 17 and 19 at the bottom of the sleeve, as best seen in FIGS. 1 and 2, and will make the intended use of the indicator fairly self-explanatory.

The simple operation of the slide guide of this invention will now be described. For example purposes, typical schedule and record information for football teams will be used, but merely as a convenience in explanation, as any desired information may be used with this slide guide, as appropriate. Looking at FIG. 1, reference numeral 30 indicates a column of symbols in use by football teams belonging to the Atlantic Coast Conference at this time. The teams in descending order are respectively, Clemson, Duke, University of Maryland, North Carolina, North Carolina State, Wake Forest and Virginia. In addition to the symbols, the entire name of the team may be also applied along with the symbol. Reference numeral 40 indicates another column of symbols, which in this example, would be the paw of a tiger to correspond and represent the Clemson tigers, the Blue Devil symbol for Duke, the figure of a terrapin for the University of Maryland, and so forth down the column. Along the edge 16 indicated by reference numeral 50, the name of the particular conference, or team area, or other appropriate information may be provided. In the example being used, the Atlantic Coast Conference has been applied. At the bottom of the panel is the window 18 and the finger or thumb recess 17.

Looking at the back of the slide guide of this invention, a panel 60 appropriately delineated by a border 62 may be provided for advertising matter, instructional steps for use of the guide, and the like. In this example it is left blank. On the lower portion of the back, another panel 70 is delineated by a border 72 and within this panel the 1974 Atlantic Coast Conference standings have been appropriately provided listing the various teams, Maryland, North Carolina State, Clemson, etc. together with the conference games, the number of wings, losses, ties, etc., and also listing all games the teams have played. Within this panel is the window opening 20 for viewing information appearing on the slide member 32. In the example being used, slide member 32 has the 1974 records for the various teams appropriately applied on one side and the 1975 schedules appropriately applied on the other side. See reference numeral 80 in FIG. 1 and reference numeral 90 in FIG. 2.

Information on the slide member has been so arranged and properly aligned with the indicator dot 26 so that, for example, if the user desires to know what the 1975 schedule for the University of Maryland team is, it is only necessary for the user to align the indicator dot and dimple 26 with the aperture to the left of the University of Maryland symbol on the front of the sleeve (FIG. 1) and the correct schedule for the University of Maryland will appear in the window opening 18. Also by merely turning the device over, the 1974 record for the University of Maryland appropriately may be viewed through the window 20. The sleeve being just slightly larger than the slide, there will be some friction between the two which will tend to retain the sleeve, as adjusted, with the black or colored indicator dot 26 appearing through an appropriate aperture 22. However, in order to assure proper alignment and positive retention of such alignment until such time as other team information is desired, the dot 26 may be dimpled to provide a more positive detent and aperture locking type action between the slide and the sleeve. This is best seen in FIG. 4, where the indicator dot 26 has been dimpled and when properly aligned with projecting dimple tends to lock into the aperture 22.

Thus it can be seen that the schedule and record indicator slide guide of this invention offers a simple, and yet very effective manner of storing desired information which is readily retrievable by a user without a great deal of skill being required.

The foregoing is considered as illustrative only of the principles of the invention. Furthr, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A schedule and record indicator for keeping abreast of future scheduled events and also past records of the same opponents comprising; a sleeve member having two rectangular flat sides, said flat sides being integral with each other along the longitudinal edges thereof to form a pocket therebetween, a third flat rectangular member slightly smaller in width than the width of the sleeve member and slidable within said sleeve member, window means in at least one of the flat sides of the sleeve, and means for frictionally retaining the slidable third member in an adjusted indicating position within the sleeve, and the means for frictionally retaining said third member in proper adjustment within the sleeve including a number of spaced holes along one edge of one side of said sleeve and an indicator portion along one edge of the third slidable member and in alignment with said spaced holes so that the third member may be properly adjuted by reference to the indicator portion as viewed through the holes.

2. The indicator as set forth in claim 1, wherein the indicator portion of the third slidable member is also dimpled so that it will tend to lock into one of the holes provided in the sleeve as the slide member is moved within said sleeve.

3. The indicator device of claim 2, wherein the information pre-provided on the slide appears in alignment with the window means when the indicator portion, dimple and holes are aligned.

4. The indicator structure of claim 3, together with finger recesses provided on one end of the sleeve for facilitating gripping the end of the slidable third member to slide same within the sleeve.

5. A schedule and record indicator of the slide type comprising; a sleeve member formed from a single sheet of carboard material folded along a line parallel to and offset from the centerline of the sheet to form a front panel and a back panel, the width of the said back panel being greater than the said front panel and with the extra width portion of the back panel being folded over the open edge of the front panel and fastened thereto by adhesive means to complete the sleeve with a pocket between the front and back panels, window means in at least one of the front and back panels, alignment apertures in at least one of said panels, a slidable member within the pocket of the sleeve having appropriate information thereon, and indicator means provided on said slidable member for viewing through the aligment apertures so that the slidable member may be accurately positioned within the sleeve so that desired information will be viewable through the window means.

6. The structure as set forth in claim 5, wherein the indicator means on said slidable member includes a dimpled colored dot along one edge of the slidable member and in alignment with the apertures of the sleeve.

7. The structure as set forth in claim 6, wherein the sleeve is provided with finger recesses at one end thereof to enable a person using the indicator to easily grasp the slidable member.

8. The structure as set forth in claim 7, wherein the alignment aperture holes along an edge of the sleeve have appropriate indicia therealong, the information provided on the slidable member being appropriately spaced relative to the alignment and indicator dimple so that when said dimple engages an associated alignment aperture the appropriate information for the selected indicia will appear in said window means.

* * * * *